United States Patent [19]

Moulton et al.

[11] 4,253,670

[45] Mar. 3, 1981

[54] SIMULATED THERMAL TARGET

[75] Inventors: Joseph R. Moulton, Fredericksburg; George R. Barr, Jr., Alexandria, both of Va.

[73] Assignee: The United States of America as represented by the Secretary of the Army, Washington, D.C.

[21] Appl. No.: 64,591

[22] Filed: Aug. 7, 1979

[51] Int. Cl.[3] ..... F41J 1/00

[52] U.S. Cl. ..... 273/407; 273/348

[58] Field of Search ..... 35/25; 250/503; 273/348, 359, 360, 362, 365, 407, 409

[56] References Cited

U.S. PATENT DOCUMENTS

| | | | |
|---|---|---|---|
| 2,933,317 | 4/1960 | Pittinger et al. | 273/362 |
| 2,972,053 | 2/1961 | Anderson | 250/503 |
| 3,339,293 | 9/1967 | Kuhlo et al. | 35/25 |

FOREIGN PATENT DOCUMENTS

| | | | |
|---|---|---|---|
| 73871 | 10/1917 | Austria | 273/348 |
| 27681 | 3/1903 | Switzerland | 273/348 |

*Primary Examiner*—William H. Grieb

*Attorney, Agent, or Firm*—Nathan Edelberg; Milton W. Lee; Max L. Harwell

[57] ABSTRACT

A low cost, easily assembled simulated thermal target for use as either a training device or as a target decoy against an enemy. Various simulated thermal targets may be constructed to appear as enemy tactical vehicles when viewed by thermal images.

12 Claims, 6 Drawing Figures

SIMULATED THERMAL TARGET

The invention described herein may be manufactured, used, and licensed by the U.S. Government for governmental purposes without the payment of any royalties thereon.

BACKGROUND OF THE INVENTION

At the present time there are no training targets available for use in night operations training that use thermal sensors. In order to simulate real-world conditions, live targets such as tanks or trucks must be used. The present simulated thermal target precludes the use of live targets since the target simulates both optical and thermal images.

Thermal imaging is soon to be deployed to enable the U.S. Army to fight at night as well as during the day. The thermal images respond to the heat patterns of the viewed scene instead of the reflected light patterns that day optics use. In order to rapidly integrate this capability to the troop level, there is an urgent requirement to provide low cost thermal targets for use as training devices. To be the most effective for training purposes, these thermal targets must also appear similar to tactical vehicles when viewed by the new thermal imagers during surveillance, or during firing training exercises. The present invention may be called a field expedient thermal target (FETT). It is anticipated that large quantities of these FETT's will be constructed by military units for use in field using thermal night sights. In addition to training purposes, the FETT's are excellent for thermal pattern decoy techniques also.

SUMMARY OF THE INVENTION

The present FETT's may be easily constructed at low cost by troops out in the field, especially since all materials are available in federal stock. Preferably the FETT's are of plywood construction, are heated with an internal heat source, such as charcoal in open cans or some combustible liquid, such as kerosene or diesel fuel, in a closed metal canister using a wick, possibly made of ⅜ inch cotton rope, which will burn unattended for approximately 8–10 hours. The FETT's have the thermal emissive surfaces and the internal heat sources combined in a specialized manner to simulate the heat emissive signature of selected military vehicles.

Each of the FETT's may be used repeatedly if training is not destructive in nature, i.e., used for target acquisition training only. However, since the cost of each FETT is low, they may be used for live gunnery practice.

Each of the FETT's may specifically be a multidimensional target frame and may be constructed of plywood connected to frame struts with a sheet metal enclosed area, which may be made of 1/32 inch galvanized steel, having a heat generating means therein. The frame struts and the plywood on the front and back sides thereof form internal cavities from the sheet metal enclosed areas to outside vents in the upper portion of the multidimensional target frame to provide a flue draft for the heat generating means. The sides of the multidimensional target frame being viewed is painted in a selective paint color scheme to simulate selective tactical thermal patterns by emanating heat therefrom in accordance with the emissivity of the particular color that is caused by heat from the heat generating means.

The present simulated thermal target will be better understood with reference to the following drawings in the detailed description.

DETAILED DESCRIPTION OF EMBODIMENTS

Figure 1:
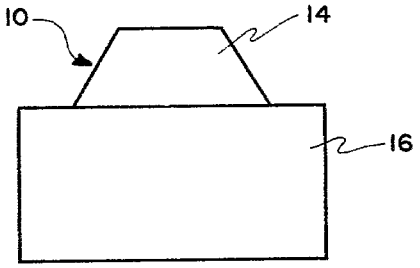
FIG. 1 illustrates a front side view of one embodiment of the present invention.
Figure 2:
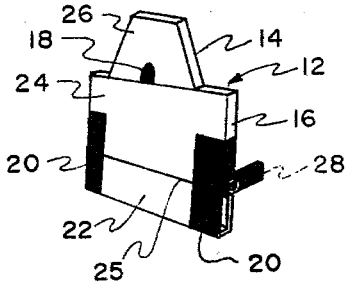
FIG. 2 shows a two-dimensional generally front side perspective view of a second embodiment.
Figure 4:
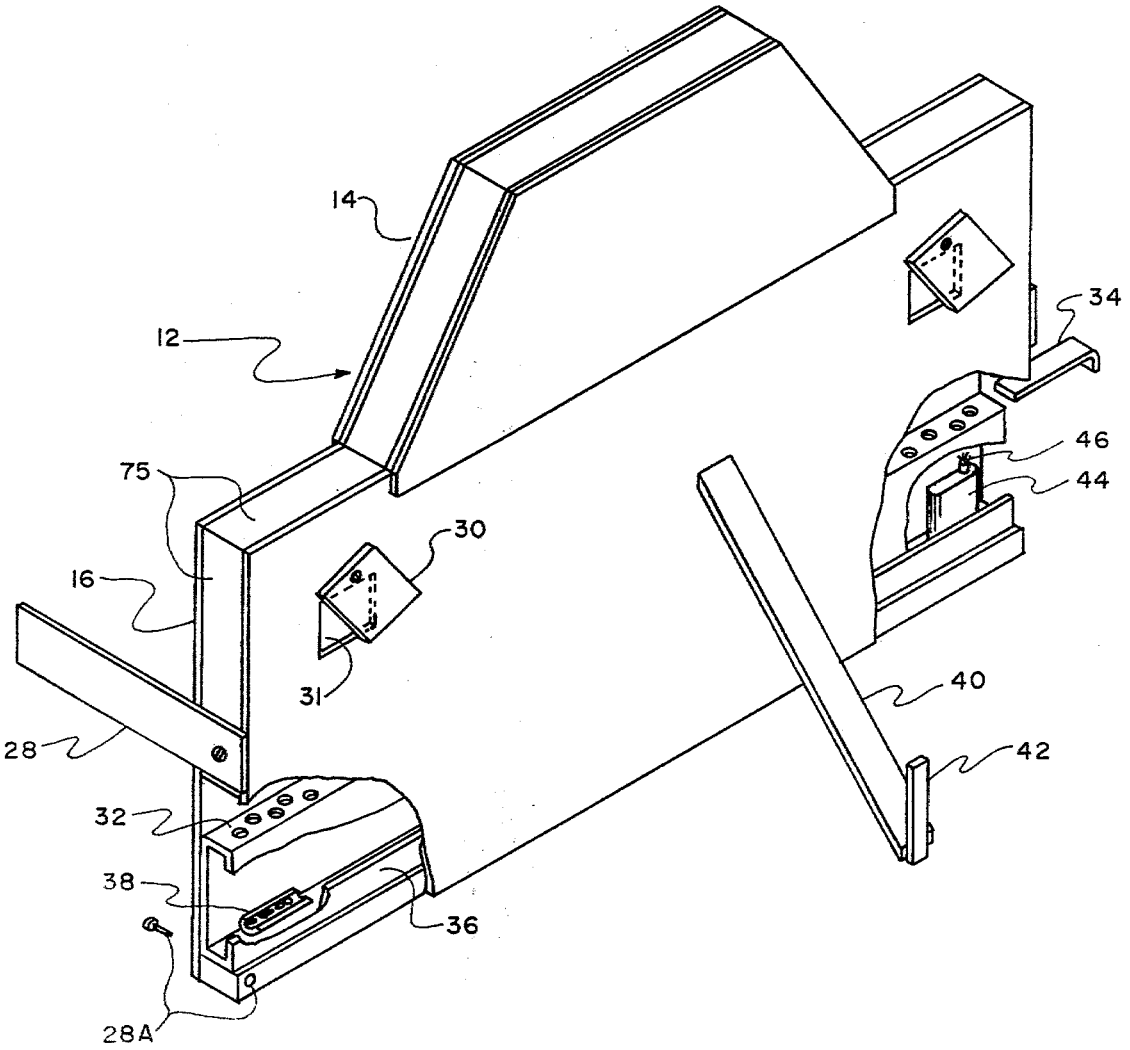
FIG. 4 illustrates a back side view of the embodiment of FIG. 2.
Figure 5:
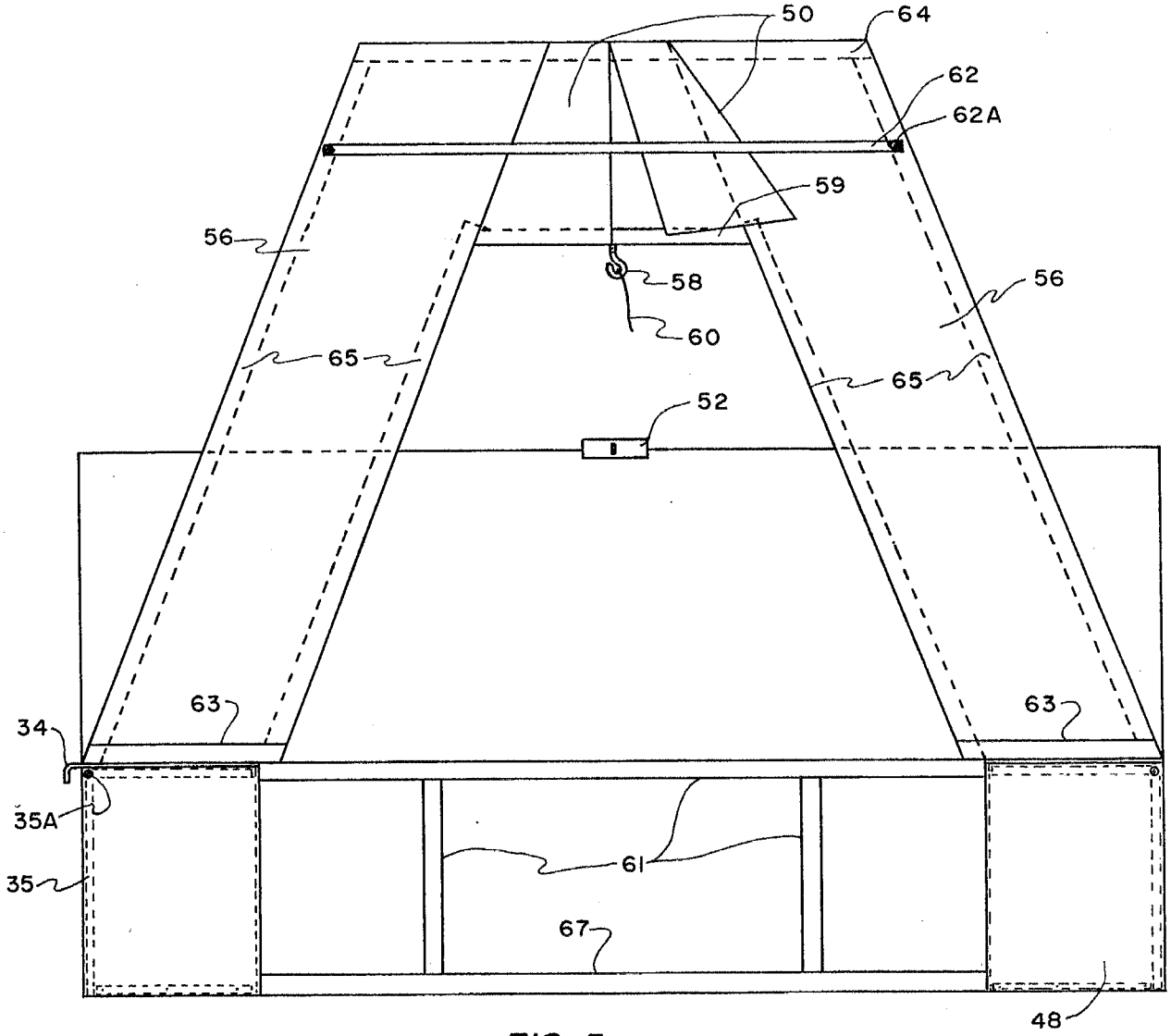
FIG. 5 shows a back side view of the FIG. 1 embodiment.
Figure 5A:
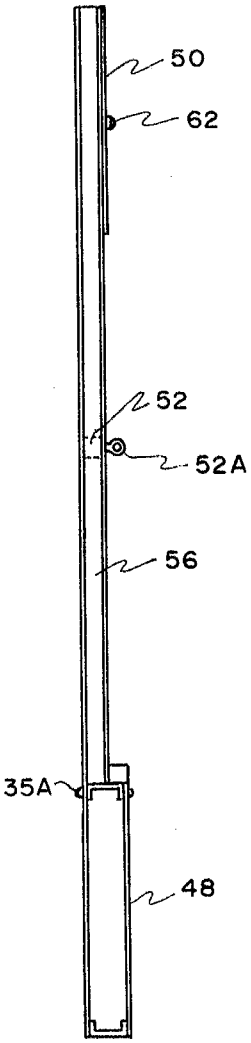
FIG. 5A illustrates a side view of FIG. 5.

The front side of a single layered simulated target 10 of FIG. 1 has a solid black color covered front side layer which is comprised of an upper frame 14 that rests on a lower support base 16. References will be made for like representative numerals as shown by the other Figures in this application. However, the main difference in the embodiment shown by FIGS. 1, 5, and 5A is that it is much lighter in weight and therefore may be used for other means of training than the embodiment shown by FIGS. 2 and 4. As an example, the embodiment of FIGS. 1, 5 and 5A may be constructed with only the front side being made of a sheet of ¼ inch plywood and the back side being generally open other than for ¼ inch plywood sheets being connected to frame struts 63, 64, and 65. The sheet metal enclosed area formed by sheet metal heat shield 48 is also enclosed. The bottom 67 of the single layered simulated target 10 preferably rests on the earth. Bottom frame struts 61 on the back side of target 10 are not covered. Simulated target 10, being of lighter weight than the double layered simulated target 12, as shown by FIGS. 2 and 4, may be used as a pop-up target for training purposes. A holder 58, such as a large nail or a screw hook, may be nailed or screwed into frame strut 59 and have a guy wire 60, or the like, attached thereto back to some convenient structure on the ground to limit the travel of the simulated target 10 in the forward direction to a vertical position when it pops-up from being originally laid flat on the ground with the back side next to the ground. A support (not shown) of some type, such as a long board, for bracing simulated target 10 to remain upright after it has popped-up may be connected to a hinged block 52. Hinged block 52 is preferably made of wood and has an eye-hook 52A thereon around which the end of the support may rotate. The other end of the support will jam back against some convenient object, such as the earth, if there is back pressure against the simulated target 10.

The construction details of the single layer simulated target 10 will be better understood in reference to FIGS. 5 and 5A, with further reference to like characteristics as shown by the embodiment in FIGS. 2 and 4. Some examples of these like characteristics are the heat shield 32 having holes in top thereof, a flat heat shield winter-summer top cover 34 that may be inserted to a depth required to control the heat retention depending upon whether a winter or summer thermal signature is to be generated, the heat shield pan 36, and heat generating means, such as an open can of at least 12 ounces in size having lighted charcoals 38 therein or a closed metal canister 44 having a combustible liquid fuel therein which a wick 46, preferably made of ⅜ inch cotton braided rope, is extended into canister 44 through an airtight opening to be in contact with the fuel. The sheet metal heat shield 48 has a plurality of holes in the top thereof (not shown) in which the flat heat shield winter-summer top cover 34 may slide over from the outside to limit the flue draft action up the internal cavities 56 which are created by side panel open areas. An outward swinging heat shield side cover door 35, shown in the closed position, is hinged about two sheet metal screws 35A to be readily opened to place the heat generating means inside the heat shield 48 and then be reclosed, or partially closed to provide partial flue draft. Top swing doors 50 function as outside vents for the internal cavities 56 flue drafts from the heat generating means to the outside. Doors 50 slide behind a tension guide 62, preferably made of wood. Doors 50 are also built up on both the top and the bottom by strips of ¼ inch plywood on frame struts 64 and 59 respectively so that the doors simply slide over the plywood panels on the back side of simulated thermal target 10. Tension guide 62 is preferably held down on each end by wood screws 62A. Doors 35 and 50 and cover 34 may all be opened the proper amount as required to provide a damper for the flue action. Some specific measurements for the embodiment of FIG. 1, 5, and 5A are an overall height of 84 inches and top width of 45½ inches and bottom width of 131 inches, with a height of the lower support base, i.e. up to the middle of hinged block 52, of 48 inches. The height of the sheet metal heat shield is preferably 20½ inches with a depth of about 15 13/16 inches and in inside width of about 3 10/16 inches. The internal cavities 56 are therefore slanted inward beginning at a height of about 20½ inches off the ground at 131 inches outer extremities up to the 84 inch level of 45½ inch outer extremities. The heat from the heat generating means within sheet metal heat shield 48, which travels through the internal cavities, causes an increase in radiation to be emanated from the solid black front side in a selective pattern generally in accordance with the pattern of the internal cavities. It should be noted here that the pattern may not be limited to the above dimensions or even the above slanted pattern.

The embodiment of FIGS. 2 and 4 will now be explained. The double layered simulated target 12, having both front and back larger panels of plywood attached to larger frame struts than the embodiment shown by FIGS. 1, 5, and 5A, is more suitable for use as a fixed simulated thermal target. The plywood in this embodiment is ½ inch and is separated 4 inches by 2 inch by 4 inch frame struts 75. The selective paint color scheme across the front is herein explained to be comprised of rectangular shaped black color patterns 20 on the lower outer portions and around the sides of the lower support frame. Also, a circular black color paint pattern 18 is positioned in the lower central portion of the upper frame just above the lower support frame 16 and represents the relative gun barrel position of an enemy tank. The rectangular shaped black color patterns 20 represent tank tracks. The black color patterns 20 may be camouflage black, or some commercial flat black. Front area 22 between patterns 20 and below a dividing line 25 is painted a dirt brown color. The dirt brown colored paint may be a mixture of black with olive drab. Front areas 24 and 26 respectively of the lower support base 16 and the upper frame 14 are preferably a flat olive drab color.

Figure 3:
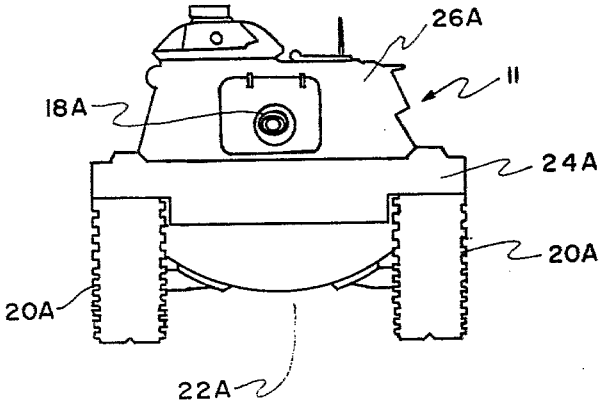
FIG. 3 depicts a replica of FIG. 2 with more details of an enemy tank.

A tank replica 11 is shown in FIG. 3 with like numerals as indicated by FIG. 2 but with the subscript A used on each of the numerals. The back side of the double layer simulated thermal target 12 is shown in more detail in FIG. 4. Target 12 may be held rigidly in the vertical position by heavy support 40, such as 1 inch by 4 inch board, attached between a stake 42 and the back side of target 12, or may be free standing between stakes on the front and back sides. The two draft holes 31 with swinging doors 30 form the outside vents for the heat generating means. The upper frame 14 may also have an outside vent (not shown) if needed. The heat shield 32 and heat shield pan 36 hold the heat generating means therein. When the heat shield side cover door 28 is swung open, the heat shield winter-summer top cover 34 may be placed on the top of the heat shield 32 to cover over the holes. After the heat generating means are placed in the heat shield pan 36 the side cover door 28 may be swung closed and tied down by a wire 28A, or the like. It should be noted that the heat shield 32 and heat shield pan 36 may be identical to the heat shield 48 of the embodiment of FIGS. 1, 5, and 5A.

While particular embodiments of the invention have been shown and described it will be obvious to those skilled in the art that various modifications may be made without departing from the spirit of the invention which is intended to be limited solely by the appended claims.

We claim:

1. A simulated field effect thermal target for providing thermal and optical images of selective tactical thermal patterns used in training of friendly personnel and decoy of an enemy when an observer views said images through thermal night viewing sights, said simulated field effect thermal target comprising:

multidimensional target frame constructed of plywood connected to frame struts forming a lower support base and an upper frame that rests on said lower support base, said multidimensional target frame having a selective paint scheme on the outer surface thereof and having internal cavities forming a flue draft feeding to outside vents in which said internal cavities are formed by sheet metal baffles enclosed by wood framing; and heat generating means positioned in the bottom of said lower support base within said internal cavities to cause heat to emanate from the paint of said selective paint color scheme to simulate said selective tactical thermal patterns.

2. A simulated thermal target as set forth in claim 1 wherein said plywood is from ¼" to ½" and said frame struts are from 2"×2" to 2"×4" wherein said lower support base has a sheet metal enclosed area in the lower portion thereof having a heat shield side cover door to the outside where said heat generating means is placed and further having a top plate with a plurality of holes therein to provide a flue draft to support combustion of said heat generating means.

3. A simulated thermal target as set forth in claim 2 wherein the structure of said sheet metal enclosed area is made of 1/32" thick galvanized steel.

4. A simulated thermal target as set forth in claim 3 wherein said heat generating means is a closed metal canister of combustible liquid with a wick extending from said combustible liquid to the outside through an airtight opening in said canister.

5. A simulated thermal target as set forth in claim 4 wherein said combustible liquid is kerosene and said wick is made of $\frac{3}{8}''$ cotton braided rope.

6. A simulated thermal target as set forth in claim 4 wherein combustible liquid is diesel fuel and said wick is made of $\frac{3}{8}''$ cotton braided rope.

7. A simulated thermal target as set forth in claim 3 wherein said heat generating means is lighted charcoals in a metal can of at least 12 ounces in size.

8. A simulated thermal target as set forth in claim 7 wherein said selective paint scheme is of entirely black color on a front side of a two dimensional target frame in which said front side is made of one layer of $\frac{1}{4}''$ plywood covering both upper frame and lower support base and said back side is open other than where said frame struts hold said sheet metal enclosed area on the outer lower extremities of said lower support base and which hold $\frac{1}{4}''$ plywood on the back side to form two symmetrical internal cavities that narrow at the top portion of said upper frame whereupon two top swing doors provide said outside vents for the flue draft formed by said internal cavities.

9. A simulated thermal target as set forth in claim 8 wherein said frame struts are $2''\times2''$ with length as appropriate.

10. A simulated thermal target as set forth in claim 9 wherein said multidimensional target frame is three dimensional defining at least two sides of a tactical target.

11. A simulated thermal target as set forth in claim 7 wherein both of said front and back sides have a layer of $\frac{1}{2}''$ plywood thereon separated 4 inches by $2''\times4''$ frame struts and wherein said selective paint scheme is a rectangular shaped black color pattern on both the lower outer portions of said front side following around each side to said back side and a black paint circular area in the lower central portion of said front side of said upper frame with a dirt brown painted area in the lower part between the lower outer portion black color and the remainder of said front side and following around each end being painted olive drab color to simulate the front of an enemy tank wherein said layers of $\frac{1}{2}''$ plywood on both front and back sides form a continuous internal cavity to said outside vents.

12. A simulated thermal target as set forth in claim 11 wherein said outside vents are on the backside of said lower support base.

* * * * *